US009050505B2

(12) United States Patent
Bond et al.

(10) Patent No.: US 9,050,505 B2
(45) Date of Patent: Jun. 9, 2015

(54) ALL-CLIMATE LACROSSE STICK HEAD

(76) Inventors: Jonathan Bond, Newton, MA (US); Christopher Morea, Baltimore, MD (US)

( * ) Notice: Subject to any disclaimer, the term of this patent is extended or adjusted under 35 U.S.C. 154(b) by 186 days.

(21) Appl. No.: 13/482,572

(22) Filed: May 29, 2012

(65) Prior Publication Data

US 2012/0302382 A1 Nov. 29, 2012

Related U.S. Application Data

(60) Provisional application No. 61/490,922, filed on May 27, 2011.

(51) Int. Cl.
*A63B 59/02* (2006.01)
*A63B 65/12* (2006.01)

(52) U.S. Cl.
CPC ..... *A63B 59/02* (2013.01); *A63B 2209/02* (2013.01)

(58) Field of Classification Search
USPC ..... 473/505, 512, 513; D21/724
See application file for complete search history.

(56) References Cited

U.S. PATENT DOCUMENTS

| | | | | |
|---|---|---|---|---|
| 3,507,495 | A | 4/1970 | Tucker et al. | |
| 4,034,984 | A | 7/1977 | Crawford et al. | |
| 4,410,661 | A * | 10/1983 | Epstein et al. | 525/66 |
| 4,473,688 | A * | 9/1984 | Zappa et al. | 525/432 |
| 4,546,147 | A * | 10/1985 | Woodbrey et al. | 525/183 |
| 5,566,947 | A | 10/1996 | Tucker et al. | |
| 2010/0000656 | A1 * | 1/2010 | Winningham et al. | 156/73.5 |
| 2011/0218060 | A1 * | 9/2011 | Vestuti et al. | 473/513 |
| 2012/0302382 | A1 * | 11/2012 | Bond et al. | 473/513 |

OTHER PUBLICATIONS

Webpage download Jul. 2, 2014, Actual date of data is not known but prior to 2005, Du Pont,www.campusplastics.com/material/pdf/202044/ZytelST801AHSNC010?sLg=en, 11 pages.*

* cited by examiner

*Primary Examiner* — Gene Kim
*Assistant Examiner* — M Chambers
(74) *Attorney, Agent, or Firm* — Ober, Kaler, Grimes & Shriver; Royal W. Craig

(57) ABSTRACT

Improved synthetic lacrosse stick heads that have more consistent performance characteristics under variable temperature and playing conditions.

18 Claims, 6 Drawing Sheets

| Data | Deflection (mm) | | | |
|---|---|---|---|---|
| | 0°C (32°F) | 23°C (73°F) | | 40°C (104°F) |
| Material | Conditioned | Dry | Conditioned | Conditioned |
| Custom Compound Average | 13.1 | 11.5 | 15.3 | 26.7 |
| ST801 Average | 13.7 | 14.6 | 23.5 | 43.7 |

| Comparisons | | Conditoned % Change | | |
|---|---|---|---|---|
| | 23°C Cond/Dry | 0°C-40°C | 0°C-23°C | 23°C-40°C |
| Custom Compound Average | 33% | 104% | 17% | 74% |
| ST801 Average | 61% | 219% | 72% | 86% |

Summary: ST801 loses nearly 2x stiffness from dry to conditioned as Custom Compound
ST801 loses over 2x stiffness from 0C-40C (conditioned) as Custom Compound

Notes:
Measurements taken at 73F (23C)
Dry = approximately 1 month after manufacture - "Store shelf" condition
Conditioned = approx 6 months after manufacture, soaked for 3 days in ~73F water
force = 4.3lbf

Material Data Sheet info
| | Tensile Modulus | | | |
|---|---|---|---|---|
| | (GPa) | (GPa) | (GPa) | (GPa) |
| | 0C | 23C | 40C derived | 60C |
| ST801A DAM | 2.176 | 2.000 | 1.725 | 1.355 |
| | -9% | 0% | 13.8% | 32% |
| ST801A Cond. | 1.698 | 0.900 | 0.510 | 0.415 |
| | -89% | 0% | 43% | 54% |
A
| Change 0-40C | |
|---|---|
| (GPa) | (%) |
| -0.451 | -21% |
| | |
| -1.188 | -70% |
B
FIG. 3
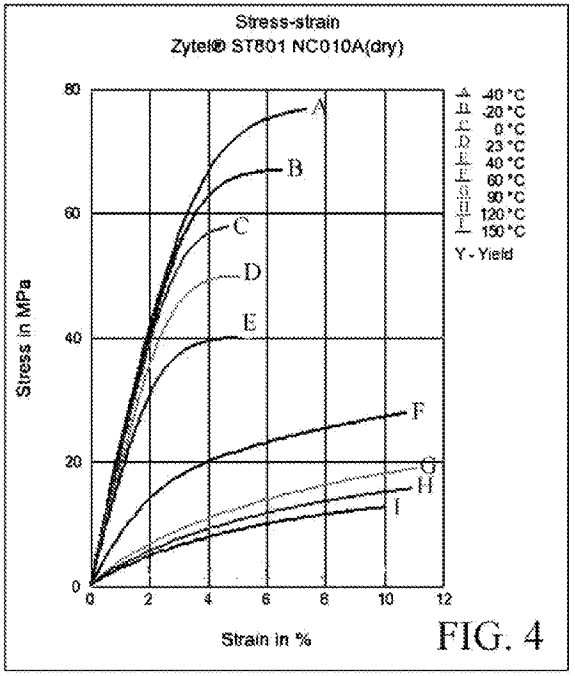
FIG. 4
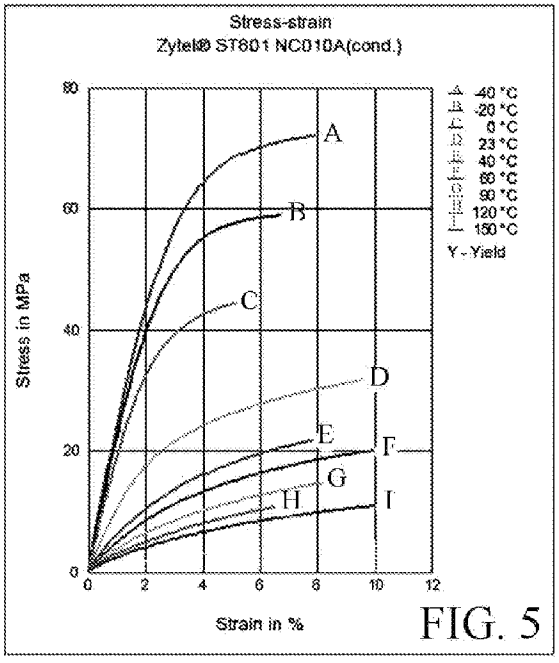
FIG. 5

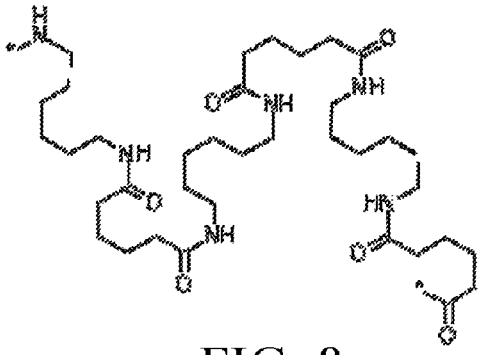

FIG. 8

Independent lab testing

| | (GPa) | (GPa) | (GPa) |
|---|---|---|---|
| | 0C | 23C | 40C |
| ST801A | 2.29 | 2.11 | 1.82 |
| | -9% | 0% | 13.7% |
| Custom Compound D | 1.76 | 1.74 | 1.61 |
| | -1% | 0% | 7% |

| Change 0-40C | |
|---|---|
| (GPa) | (%) |
| -0.47 | -21% |
| | |
| -0.15 | -9% |

RTP Nylon Conditioning test @ 23C

| | Flex Str | Flex Mod | % Moisture |
|---|---|---|---|
| | (MPa) | (MPa) | |
| PA66-I Dam | 68 | 1790 | 0% |
| PA66-I COND | 24 | 620 | 2.7% |
| Custom Compound A DAM | 69 | 1720 | 0% |
| Custom Compound A COND | 35 | 900 | 2.5% |
| PA66-I COND | 24 | 620 | 2.7% |
| Custom Compound A DAM | 69 | 1720 | 0% |
| Custom Compound A COND | 35 | 900 | 2.5% |

| Change DAM-COND | | | |
|---|---|---|---|
| Flex Str | | Flex Mod | |
| (MPa) | (%) | (MPa) | (%) |
| 44 | 65% | 1170 | 65% |
| | | | |
| 34 | 49% | 820 | 48% |
| 44 | 65% | 1170 | 65% |
| | | | |
| 34 | 49% | 820 | 48% |

Note: samples conditioned in the same environment

FIG. 9

| Data | Deflection (mm) | | | |
|---|---|---|---|---|
| | 0°C (32°F) | 23°C (73°F) | | 40°C (104°F) |
| Material | Conditioned | Dry | Conditioned | Conditioned |
| Custom Compound Average | 13.1 | 11.5 | 15.3 | 26.7 |
| ST801 Average | 13.7 | 14.6 | 23.5 | 43.7 |

| Comparisons | | Conditoned % Change | | |
|---|---|---|---|---|
| | 23°C Cond/Dry | 0°C-40°C | 0°C-23°C | 23°C-40°C |
| Custom Compound Average | 33% | 104% | 17% | 74% |
| ST801 Average | 61% | 219% | 72% | 86% |

Summary:

ST801 loses nearly 2x stiffness from dry to conditioned as Custom Compound
ST801 loses over 2x stiffness from 0C-40C (conditioned) as Custom Compound

Notes:
Measurements taken at 73F (23C)
Dry = approximately 1 month after manufacture - "Store shelf" condition
Conditioned = approx 6 months after manufacture, soaked for 3 days in ~73F water
force = 4.3lbf

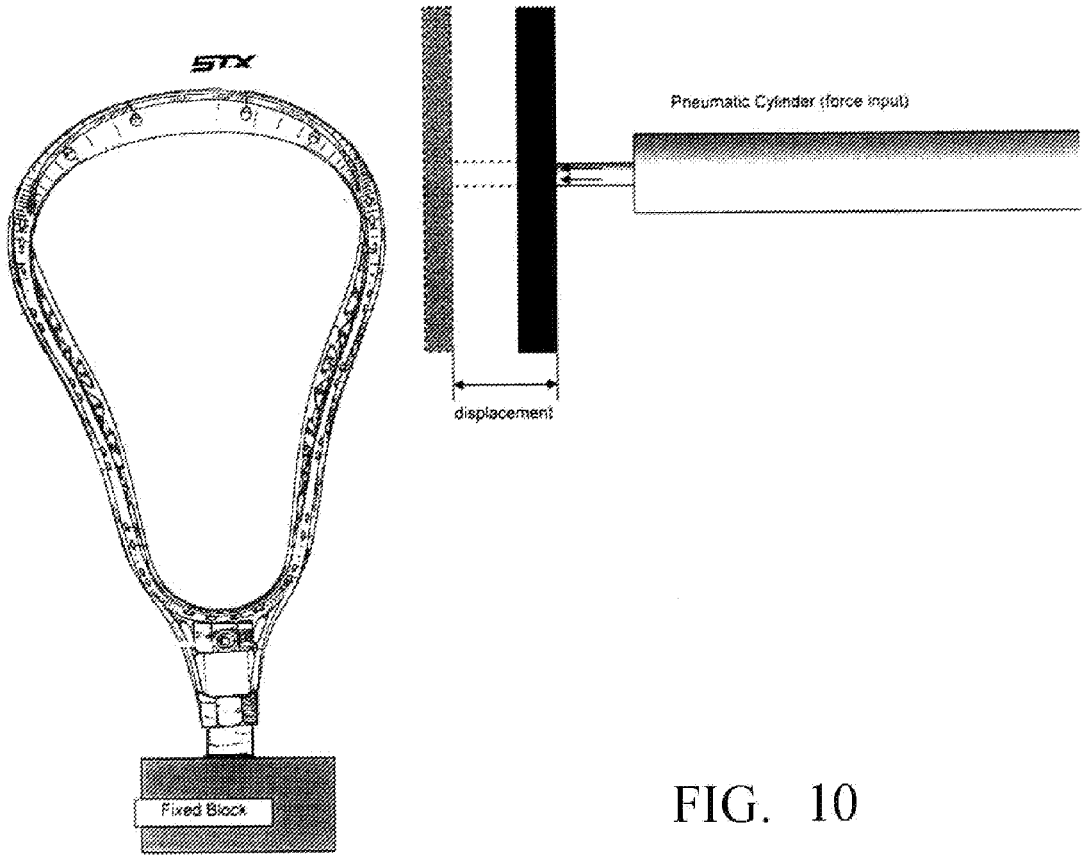

FIG. 10

ALL-CLIMATE LACROSSE STICK HEAD

CROSS-REFERENCE TO RELATED APPLICATIONS

The present application derives priority from U.S. provisional application Ser. No. 61/490,922 filed May 27, 2011.

BACKGROUND OF THE INVENTION

1. Field of the Invention

The present invention relates generally to lacrosse sticks, and more particularly, to synthetic lacrosse stick heads that have more consistent performance characteristics under variable playing conditions.

2. Description of the Background

In 1970, the introduction of double-wall, synthetic lacrosse heads revolutionized the game of lacrosse. In comparison to the traditional wooden single-wall heads, the synthetic heads imparted a lightness, maneuverability, and flexibility never-before experienced by lacrosse players. These performance advantages greatly enhanced players' skills such as throwing, catching, cradling, and scooping, and brought the sport of lacrosse to new levels of speed and excitement.

FIG. 1 illustrates a conventional molded head lacrosse stick. As shown, lacrosse stick 100 comprises a handle 102 shown in dotted lines, and a double-wall synthetic head 104. Head 104 comprises a generally V-shaped frame having a juncture 106, sidewalls 108 and 110, a transverse wall (or "scoop") 112 joining the sidewalls at their ends opposite juncture 106, and a stop member 114 joining sidewalls 108 and 110 at their ends nearest juncture 106. As shown, handle 102 fits into and through juncture 106, and abuts stop member 114. A screw or other fastener placed through opening 107 secures handle 102 to head 104.

FIGS. 2 (A & B) illustrates a conventional injection molded goalie head comprising the same components as a field player's lacrosse stick illustrated in FIG. 1 but with different overall shape due to its generally larger dimensions.

The typical features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

The traditional double-wall synthetic head is an injection-molded, monolithic structure. Examples of suitable synthetic materials well known in the art include nylon, polypropylene (PP), polyethylene (PE), amorphous polar plastics (e.g., polycarbonate (PC)), polymethylmethacrylate (PMMA), polystyrene (PS), high impact polystyrene (HIPS), polyphenylene oxide (PPO), glycol modified polyethylene terphthalate (PETG), acrylonitrile butadiene styrene (ABS), semicrystalline polar plastics (e.g., polyester PET and PBT), polyamide (e.g., Nylon 6 and Nylon 66), urethane, polyketone, polybutylene terephalate, acetals (e.g., Delrin™ by DuPont), acrylic, acrylic-styrene-acrylonitrile (ASA), metallocene ethylene-propylene-diene terpolymer (EPDM) (e.g., Nordel™ by DuPont), and composites. When first introduced, these materials were clearly superior to wood, offering players improved handling and durability. For example, a lacrosse head constructed of DuPont™ ZYTEL ST 801 nylon resin is able to withstand the bending and harsh impacts inherent to competition far better than a traditional wooden stick. As another example, polycarbonate, though having a flexibility similar to wood, is more structurally durable than wood and much lighter and, therefore, easier to handle.

Although the synthetic materials mentioned afford significant performance advantages over wooden sticks, the use of these conventional materials in a one-piece monolithic head limits a manufacturer's ability to provide heads suitable for the modern game. Lacrosse at virtually all levels now has a competitive season stretching from early February through late May, and is played in schools and leagues throughout the world. Additional competitive play occurs during the summer and fall, particularly in many sections of the United States. References in this application to "competitive play", "competitive sticks" and the like refer to lacrosse games and sticks that are subject to a governing body set of rules and regulations, such as the NCAA for men's lacrosse, US Lacrosse for women's lacrosse, the National Federation of State High School Association for much of high school lacrosse and variations adopted by individual private school and recreational leagues. Such terms do not refer to articles that have some or all of the basic components of lacrosse sticks (e.g. STX "Fiddle STX") but which due to their overall size, durability, etc. are not intended for use in competitive play.

Because competitive lacrosse is now essentially a year-round activity, lacrosse equipment is subjected to a wide range of climatic playing conditions, especially with respect to temperature and humidity. Playing temperatures can range from 32 F/0 C to 104 F/40 C, and humidity from single digit to near 100%. Thus, there is a need for a competition lacrosse head that will satisfy playing performance needs in extreme as well as moderate climatic conditions.

As noted, conventional men's and women's lacrosse heads have been made with impact modified Nylon 6,6 (PA66-I), commercially known as ZYTEL™ ST 801, which has a good balance of stiffness, light weight, strength, and impact resistance. However, standard commercially available PA66-I has at least two issues affecting its performance: 1) flexibility (i.e., tensile and flexural modulus) variation with temperature; and 2) moisture absorption, which affects material properties, in particular glass transition temperature.

As with most materials, PA66-I has reductions in tensile and flexural moduli as temperature increases (i.e., a reduction in stiffness) and increases in tensile and flexural moduli as temperature decreases (i.e., an increase in stiffness). For the modern lacrosse player, this dynamic results in an overly flexible head in warm temperatures and a very stiff head in colder temperatures. Both of these conditions can affect play negatively. Excessively flexible heads contribute to inaccurate passes and shots, difficulty catching, ineffectual checking, and even goals allowed due to goalie heads flexing excessively during quick movements while attempting saves. Heads that are too stiff tend to be more brittle, which can cause unwanted harsh vibration when catching and checking, loss of "ball feel", and increased head breakage. Moisture absorption compounds these problems, in part due to a change in the glass transition temperature of PA66-I as it conditions (absorbs moisture).

FIG. 3 is a chart comparison taken from Material Data Sheets for ZYTEL™ ST 801A (generic name PA66-I) in the "dry-as-molded" (DAM) state, and ST 801A moisture-conditioned after molding with Young's modulus, also known as the tensile modulus, shown in gigapascals (GPa) (e.g., $kN/mm^2$). In the "dry-as-molded" (DAM) state, with zero absorbed moisture, the glass transition temperature of PA66-I is approximately 75 deg C. (see data), which is well above playing temperatures. Below the glass transition temperature, the material has fairly constant tensile modulus; above the glass transition temperature tensile modulus is much lower but mostly constant. Near the glass transition temperature, however, tensile modulus drops rapidly.

As a lacrosse head absorbs moisture, which inevitably occurs when it is exposed to the atmosphere, the glass transition temperature of PA66-I drops to approximately 23 deg. C. This condition is much closer to typical lacrosse playing conditions when even small changes in temperature cause very large swings in tensile modulus and therefore head performance. One way this manifests itself is through inconsistent stiffness and flex in heads. In addition, PA66-I loses approximately one-half its tensile modulus as it conditions or absorbs moisture. Since many lacrosse heads are stored in relatively humid environments, such as locker rooms and warehouses, and much of the country plays in climates with high heat and high humidity, the material in conventional heads rapidly absorbs moisture, causing it to become softer over time and more variable with temperature change.

The graphs of FIGS. 4-5 illustrate the point with respect to dry and conditioned ZYTEL 801. The data in FIGS. 4-5 was collected by subjecting both conditioned and non-conditioned head frames to a standard flexibility test. Focusing on the data points at 23 C, a normal lacrosse playing condition, the strain % of Zytel 801 (FIG. 5) is about double that of unconditioned or "dry" Zytel 801 (FIG. 4). Lacrosse heads made from this same material perform similarly as the data describes.

This variability in conventional heads under different playing conditions makes it very hard for players to anticipate their head's performance. For example, with temperature changes such as those discussed, a head could be 50% more flexible when used during a day game than it was during a game the previous night. This lack of consistency and reliability is what the invention addresses, i.e., a reduction in the performance differences of lacrosse heads when exposed to cold and warm temperatures.

It would be greatly advantageous to provide a custom compound designed to counteract the effects of conditioning and temperature change.

SUMMARY OF THE INVENTION

The head of the invention features less variation in tensile/flexural modulus, lower loss of tensile/flexural modulus with moisture absorption and performs closer to its "normal" 73 F playing condition after moderate conditioning. Hence, over the course of a climatic year, the head will perform more consistently regardless of weather conditions.

The invention will also satisfy divergent performance characteristics now required of lacrosse heads. For example, portions of a lacrosse head need to be more flexible to be better suited for passing, shooting, and severe bending, such as the bending encountered during face-offs and when scooping ground balls. On the other hand, some players such as defensemen, prefer a strong, rigid lacrosse head for hard checking offensive players carrying the game ball. With a conventional head, the manufacturer must choose a material that attempts to serve both disparate purposes (flexibility and rigidity). Although the manufacturer can compensate somewhat for this performance tradeoff by using structural elements (e.g., increasing the thickness of the sidewalls), the practical result of the tradeoff is a lacrosse head that satisfies neither purpose optimally and results in more weight from thickened sections of the head.

Another significant tradeoff pertains to the hardness of the lacrosse head. To provide the rigidity necessary to handle and protect the ball, and to provide the durability necessary to endure the severe impacts of the game, synthetic materials must possess a substantial degree of stiffness, strength, and abrasion resistance. In an effort to soften the hard monolithic heads, some designs, such as that disclosed in British Patent No. 424,742 to Muir, simply add soft materials to a hard (wooden) lacrosse head frame. The rubber sheath in Muir covers the lacrosse head frame but does not bond to the frame such that the components move in unison and provide the solid feel of a monolithic head.

Another example of a performance tradeoff concerns the rigidity of the lacrosse head frame in relation to the tightness of the pocket strings. With conventional one-piece monolithic lacrosse heads, the stiffer the material of the head, the less the head flexes or "gives" in response to tension on the pocket. As a result, the pocket in a women's lacrosse head can become excessively tight, such that impact with the ball causes a trampoline effect that makes the ball hard to catch and control. In essence, the pocket, strung on a rigid unforgiving frame, acts like the strings of a tennis racquet and rebounds the ball out of the pocket. This trampoline effect is especially troublesome for women's lacrosse sticks, which have shallower and more tightly strung pockets than men's lacrosse sticks. (According to US Lacrosse rules, the combined height of the sidewall and pocket of women's lacrosse stick cannot exceed 2½ inches, while under NCAA rules, the men's can be up to 4¼ inches, in effect allowing a standard 2½ inch ball to sag 2 inches below the men's sidewall.) Again, restricted to a conventional one-piece monolithic head, a manufacturer could use a more flexible, dampening head material to reduce the trampoline effect. However, the more flexible the material, the less suitable the head is for accurate passing and shooting in warmer temperatures.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 3 is a chart comparison of the Material Data Sheet info for test heads made of Zytel™ 801

FIGS. 4-5 are graphs of stress-strain relationships of test heads made of Zytel™ 801, collected by subjecting both conditioned and non-conditioned head frames to a standard flexibility test.

FIG. 8 represents the chemical formula of nylon 6/6.

FIG. 9 is a chart comparison of independent lab tests performed on identical test heads made of Zytel™ 801 and the custom compound of the present invention.

FIG. 10 is a chart comparison of deflection tests of test heads made of Zytel™ 801 and the custom compound of the present invention.

DETAILED DESCRIPTION OF THE PREFERRED EMBODIMENT

Figure 1:
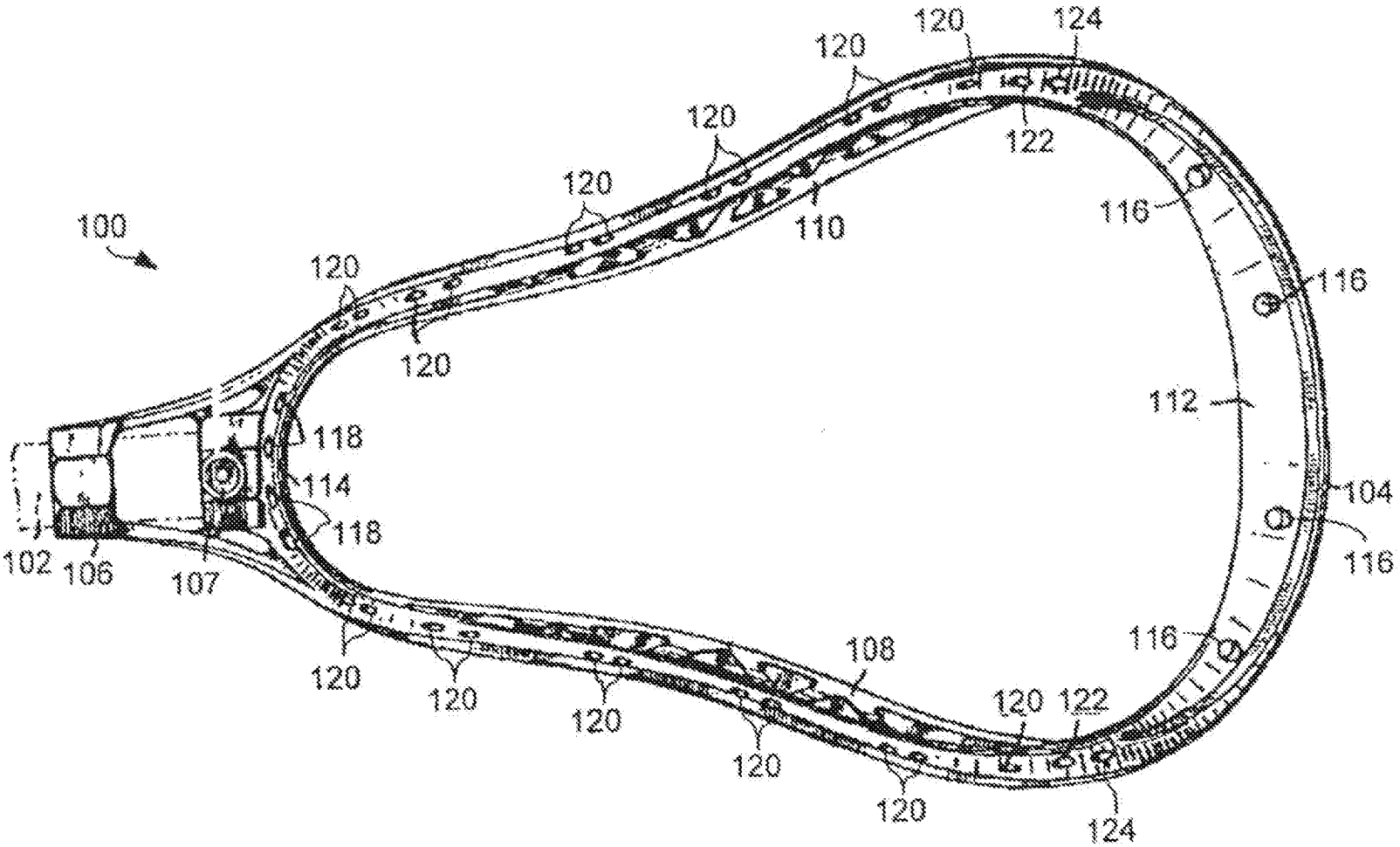
Fig. 1 (PRIOR ART)
FIG. 1 illustrates a conventional molded head lacrosse stick.
Figure 2:
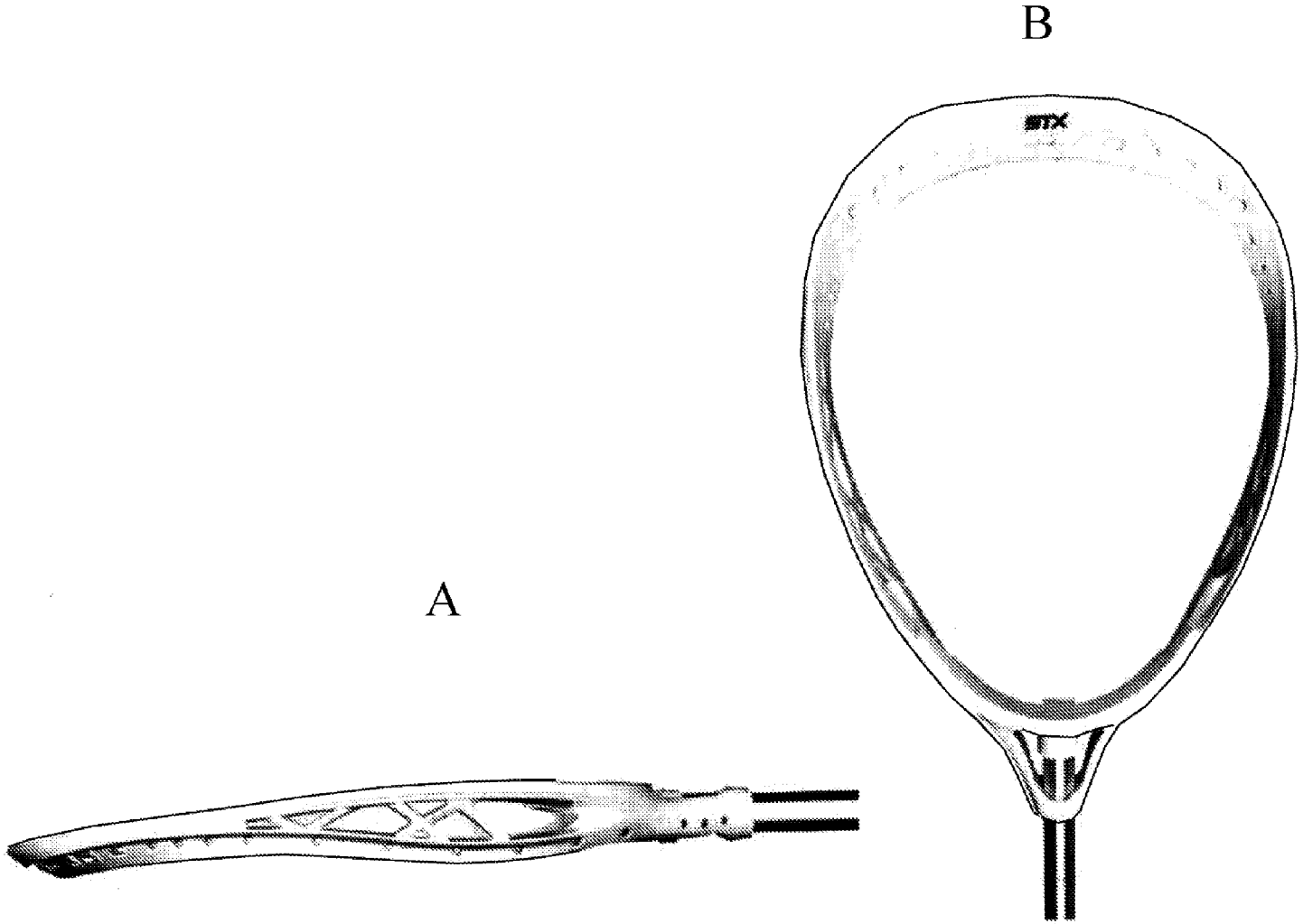
FIG. 2 illustrates a conventional injection molded goalie head comprising the same components as a field player's lacrosse stick illustrated in FIG. 1 but having a different overall shape due to its generally larger dimensions.
Figure 6:
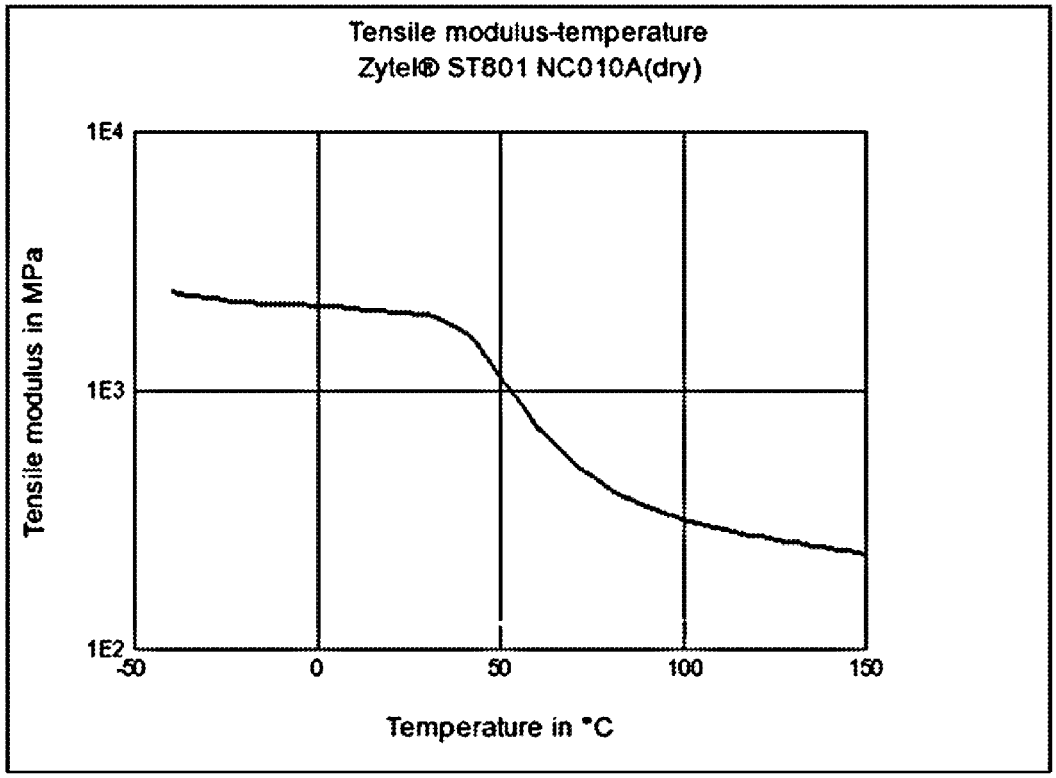
FIGS. 6-7 are graphs of tensile modulus versus temperature relationships of test heads made of Zytel™ 801.
Figure 7:
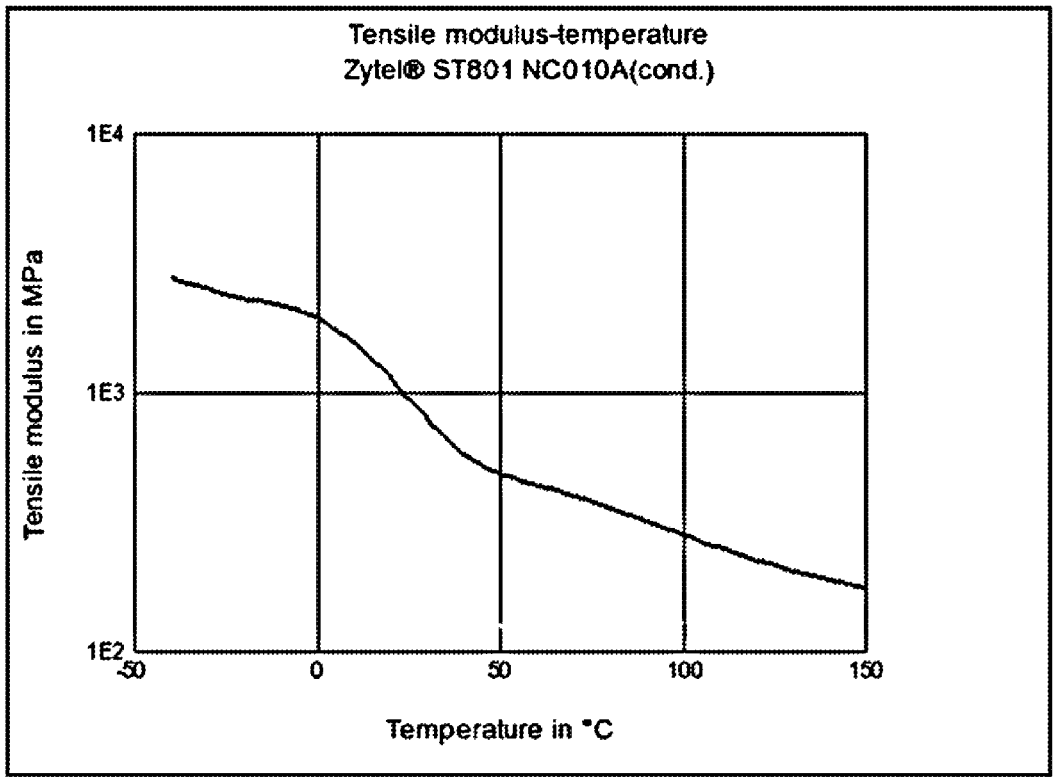

Reference will now be made in detail to preferred embodiments of the present invention, examples of which are illustrated in the accompanying drawings. Wherever possible, the same reference numbers will be used throughout the drawings to refer to the same or like parts.

The present invention is a one-piece monolithic lacrosse stick head that solves the performance tradeoffs associated with the conventional one-piece monolithic lacrosse heads. The individual material(s) of the monolithic construction satisfy specific, often divergent, performance criteria of the lacrosse head, e.g., normalization of flexibility under variable climate conditions. The present invention enhances ball control under said variable climate conditions.

In an embodiment of the present invention, an exemplary lacrosse stick head is made from the single-shot injection molding of a custom material that satisfies desired stiffness and flexibility requirements under variable climate conditions. The material can be any thermoplastic that satisfies the performance properties discussed herein, including tensile modulus between 1.25 GPa and 2.5 GPa that undergoes a temperature-dependent tensile modulus change of less than about 15% when exposed to a temperature range of 0 C to 40 C, thereby limiting the extent to which said head frame becomes more flexible when the ambient temperature approaches 40 C and less flexible when the ambient temperature approaches 0 C.

The custom composition may, for example, be a custom blend Nylon 6/6 modified with EPDM rubber or other elastomeric toughening agents know in the art, in amounts between 5% and 30% (by weight) for high physical strength, ductility, heat resistance and chemical resistance. Nylon 6/6 comprises hexamethylenediamine and adipic acid. EPDM is Ethytene propylene diene monomer. In addition, fillers such as fiberglass, carbon fiber, mineral fill and the like can be added in small quantities (up to 5% by weight) to create the custom compound.

Alternately, the custom composition may be a custom blend Nylon 6/6 modified with other compatible and commercially available nylons, such as nylon 6, nylon 4/6, nylon 6/10, nylon 6/12, nylon 11 and nylon 12 in amounts between 5% and 30% (by weight) to create the necessary higher glass transition temperatures while also enhancing the material's strength and toughness and reducing flex modulus. The family of nylons includes several different types:

Nylon 6/6, nylon 6, nylon 6/10, nylon 6/12, nylon 11, nylon 12, and nylon 6-6/6, the numbers generally indicating the number of methyl units (—CH2-) on each side of the nitrogen atoms (amide groups). The number of methyl units influences the property profiles of the various nylons, and these profiles can be combined to satisfy the above-described performance properties: tensile modulus between 1.25 GPa and 2.5 GPa that undergoes a temperature-dependent tensile modulus change of less than about 15% when exposed to a temperature range of 0 C to 40 C. This likewise limits the extent to which said head frame becomes more flexible when the ambient temperature approaches 40 C and less flexible when the ambient temperature approaches 0 C. For example, Nylon 6/12 has lower modulus, higher elongation, lower strength, lower thermal distortion temperature, lower hardness and lower melting point than Nylon 6/6, and its moisture absorption is approximately half of that of nylon 6/6. Therefore, adding Nylon 6/12 to Nylon 6/6 tailors the performance profile as desired. Consequently, the custom composition of the present invention may be a custom blend Nylon 6/6 modified with other commercially available Nylons, including any from among the group of Nylon 6, Nylon 4/6, Nylon 6/10, Nylon 6/12, Nylon 11 and Nylon 12. Specifically, it has been determined that a custom blend Nylon 6/6 within a range of from between 95% and 70% (by weight %) modified with one or more of the aforesaid commercially available Nylons within a range of from between 5% and 30% (by weight %) will suffice to create the necessary higher glass transition temperatures while also enhancing the material's strength and toughness and reducing flex modulus.

Examples

As a specific example of the custom composition of the present invention, a suitable custom blend comprises 95% Nylon 6,6 (wt %) and 5% EPDM (wt %). The hexamethylene diamine and adipic acid were combined with water in a reactor to produce nylon salt. The nylon salt was then sent to an evaporator where excess water is removed. The nylon salt was placed in a reaction vessel where a continuous polymerization process takes place. This chemical process makes molten nylon 6,6 having the chemical formula shown in FIG. 8, with a total of 12 carbon atoms in each repeating unit. The molten nylon 6,6 is then combined with the EPDM in a mixing process, where the nylon 6,6 and EDPM are co-extruded to form the custom composition. The custom composition nylon is then air-cooled to form pellets. The pellets are then molded to form a one-piece competition lacrosse head frame having sidewalls joined at their lower ends by a throat and diverging generally outwardly from each other before connecting at their upper ends by a transverse wall.

A suitable custom blend Nylon 6/6 was created for these purposes by RTP Co. of Winona, Minn. The resulting head has a tensile modulus between 1.25 GPa and 2.5 GPa and when exposed to a temperature range of 0 C to 40 C, it undergoes a temperature-dependent deflection change of no more than 40% of that of conventional competition lacrosse head frames made from other polymers within this same tensile modulus range. This effectively limits the extent to which the head frame of the present invention becomes more flexible when the ambient temperature approaches 40 C, and limits the extent to which it becomes less flexible when the ambient temperature approaches 0 C.

Independent lab tests were performed on identical test heads made of Zytel™ 801 and the custom compound of the present invention. FIG. 9 is a table of the comparative results. FIG. 10 is a chart comparison of deflection tests of test heads made of Zytel™ 801 and the custom compound of the present invention.

The data confirms that heads made from Zytel™ 801 exhibit significant property changes within the temperature ranges described. For example in FIG. 10 column 1, in colder temperatures the heads became stiffer (e.g. the heads deflected only 13.7 mm at about 0 C compared with deflecting 23.5 mm at about room temperature), and in warmer temperatures the Zytel™ 801 heads became more flexible (e.g. the heads deflected 43.7 mm at about 40 C compared with deflecting 23.5 mm at about room temperature). The custom compound of the present invention counteracts these effects of conditioning and temperature change.

The tensile modulus preferably exhibits at most a 15% absolute change when temperature fluctuates between 0-40 C (30-70 F), and even more preferably exhibits only a 9% absolute change as shown when temperature fluctuates between 0-40 C (30-70 F). In addition, the tensile modulus remains within a range of from 1.25 GPa to 2.5 GPa throughout that temperature range between 0-40 C (30-70 F), and even more preferably within a range as shown of from 1.6 GPa to 1.8 GPa throughout that temperature range between 0-40 C (30-70 F). This equates to approximately 40% of the deflection change of a conventional competition lacrosse head frame made from other polymers such as Zytel™ 801 within said tensile modulus range. The present invention is much less susceptible to variations in flexibility when the ambient temperature approaches 40 C, or when the ambient temperature approaches 0 C.

In another embodiment of the invention, a lacrosse stick head is provided with sections made of different nylon compositions, each section of which is strategically located to satisfy disparate performance characteristics for the head. For example, an exemplary lacrosse stick head may be made by the two-shot injection molding of materials such as PA66-I and the custom blend nylon of the present invention. By using both materials, the present invention can optimize in a one-piece head frame more than two disparate performance criteria by making certain sections of the lacrosse head less susceptible to climate change (e.g. scoop 112 of FIG. 1 and sidewalls 108 and 110), while leaving other sections of the head (e.g. throat 106, 114) to perform conventionally, that is to undergo more change in flex-modulus in different weather conditions.

Those skilled in the art will understand that various modifications and variations can be made in the present invention without departing from the spirit or scope of the invention. It is to be understood, therefore, that the invention may be practiced otherwise than as specifically set forth in the appended claims.

What is claimed is:

1. A one-piece competition lacrosse head frame, comprising:

a head including opposing sidewalls joined at one end by a throat, said sidewalls diverging generally outwardly, and said sidewalls being connected at another end by a transverse wall;

said head consisting essentially of a blend of a nylon polymer and an elastomer combined to have a tensile modulus that remains substantially constant to within a 15% absolute deviation in said tensile modulus within a temperature range of 0 C to 40 C.

2. The one-piece competition lacrosse head frame according to claim 1, wherein said blend comprises a first amount of nylon 6/6 within a range of from 70-95% wt %, and a second amount of elastomer within a range of from 30-5% wt %.

3. The one-piece competition lacrosse head frame according to claim 2, wherein said first amount of nylon 6/6 is approximately 95% wt %, and said second amount of elastomer is approximately 5% wt %.

4. The one-piece competition lacrosse head frame according to claim 2, wherein said second constituent is EPDM rubber.

5. The one-piece competition lacrosse head frame according to claim 2, further comprising a filler chosen from among a group consisting of fiberglass, carbon fiber, and mineral filler, combined with said first amount of nylon 6/6 and said second constituent in an amount less than or equal to 5 total wt %.

6. The one-piece competition lacrosse head frame according to claim 1, wherein said head comprises a nylon polymer having a tensile modulus within a range of between 1.25 GPa and 2.5 GPa within a temperature range of 0 C to 40 C.

7. The one-piece competition lacrosse head frame according to claim 6, wherein said head comprises a modified nylon polymer.

8. The one-piece competition lacrosse head frame according to claim 7, wherein said head comprises a modified nylon 6/6 polymer.

9. The one-piece competition lacrosse head frame according to claim 6, wherein said head does not become more flexible when ambient temperature approaches 40 C.

10. The one-piece competition lacrosse head frame according to claim 9, wherein said head does not become less flexible when ambient temperature approaches 0 C.

11. The one-piece competition lacrosse head frame according to claim 6, wherein said head comprises a nylon polymer having a tensile modulus within a range of between 1.6 GPa to 1.8 GPa within a temperature range of 0 C to 40 C.

12. The one-piece competition lacrosse head frame according to claim 6, wherein said head exhibits no more than a 9% absolute change in tensile modulus when temperature fluctuates between 0-40 C.

13. A one-piece competition lacrosse head frame having sidewalls joined at their lower ends by a throat and diverging generally outwardly from each other before connecting at their upper ends by a transverse wall, said head frame consisting essentially of a blend of an impact-modified nylon polymer in an amount between 95% to 70% by weight, and between 5% to 30% by weight of any one from among the group consisting of nylon 6, nylon 4/6, nylon 6/10, nylon 11 and nylon 12, said head frame having a tensile modulus that remains substantially constant to within a 15% absolute deviation in said tensile modulus within a temperature range of 0 C to 40 C.

14. The one-piece competition lacrosse head frame according to claim 13, wherein said head frame comprises a nylon polymer having a tensile modulus within a range of between 1.25 GPa and 2.5 GPa within a temperature range of 0 C to 40 C.

15. The one-piece competition lacrosse head frame according to claim 14, wherein said head comprises a nylon polymer having a tensile modulus within a range of between 1.6 GPa to 1.8 GPa within a temperature range of 0 C to 40 C.

16. The one-piece competition lacrosse head frame according to claim 13, wherein said blend comprises nylon 6/6 in approximately 95% wt.

17. The one-piece competition lacrosse head frame according to claim 13, further comprising a filler chosen from among a group consisting of fiberglass, carbon fiber, and mineral filler.

18. The one-piece competition lacrosse head frame according to claim 13, wherein said head comprises a modified nylon 6/6 polymer.

* * * * *